US005988041A

United States Patent [19]

Hiramatsu et al.

[11] Patent Number: 5,988,041

[45] Date of Patent: Nov. 23, 1999

[54] PISTON FOR COMPRESSORS

[75] Inventors: Osamu Hiramatsu; Shigeki Kanzaki; Kazushige Murao; Takahiro Hoshida, all of Kariya, Japan

[73] Assignee: Kabushiki Kaisha Toyoda Jodoshokki Seiksakusho, Aichi-ken, Japan

[21] Appl. No.: 08/893,050

[22] Filed: Jul. 14, 1997

[30] Foreign Application Priority Data

Jul. 15, 1996 [JP] Japan ..... 8-184752

[51] Int. Cl.[6] ..... F01B 31/10

[52] U.S. Cl. ..... 92/71; 92/165 PR; 417/222.2; 184/6.17

[58] Field of Search ..... 417/222.2; 92/71, 92/165 PR; 184/6.17

[56] References Cited

U.S. PATENT DOCUMENTS

| | | | |
|---|---|---|---|
| 5,174,728 | 12/1992 | Kimura et al. | 417/222.2 |
| 5,382,139 | 1/1995 | Kawaguchi et al. | 417/269 |
| 5,490,767 | 2/1996 | Kanou et al. | 92/71 |
| 5,498,140 | 3/1996 | Kawaguchi et al. . | |
| 5,706,716 | 1/1998 | Umemura | 92/163 PR |
| 5,720,215 | 2/1998 | Asplund et al. | 92/71 |

FOREIGN PATENT DOCUMENTS 861237 3/1996 Japan .

*Primary Examiner*—Timothy S. Thorpe
*Assistant Examiner*—Cheryl J. Tyler
*Attorney, Agent, or Firm*—Morgan & Finnegan, L.L.P.

[57] ABSTRACT

A piston for use in a compressor that compresses gas containing lubricating oil is disclosed. The compressor includes a housing having a crank chamber and cylinder bores, and a swash plate located in the crank chamber. The swash plate is operably connected to the pistons by shoes to convert the rotation of a drive shaft to the reciprocation of each piston. Each piston has a head for compressing the gas supplied to the cylinder bore and a skirt projecting from the head toward the crank chamber. The skirt is connected to the swash plate. A restrictor is provided on the skirt to prevent the piston from rotating in the cylinder bore. The restrictor has a pair of arched surfaces slidably contacting an inner surface of the housing and a recessed surface located between the arched surfaces and free from contact with the inner surface. The recessed surface defines a gap for allowing passage of the oil between the recessed surface and the inner surface. The gap leads the oil in the crank chamber toward the shoes when the piston moves from a top dead center position to a bottom dead center position.

23 Claims, 5 Drawing Sheets

PISTON FOR COMPRESSORS

BACKGROUND OF THE INVENTION

1. Field of the Invention

The present invention relates to piston type compressors that convert rotation of a rotary shaft to linear reciprocation of a piston with a driving body such as a swash plate, and more particularly, to pistons used in such compressors.

2. Description of the Related Art

Compressors are employed in air-conditioning systems for vehicles. Piston type compressors are used in such systems. A typical piston type compressor is provided with a driving body, such as a swash plate, to reciprocate pistons. The swash plate is supported by a drive shaft in a crank chamber and converts the rotation of the drive shaft to the linear reciprocation of each piston in an associated cylinder bore. The reciprocation of the piston draws refrigerant gas into the cylinder bore from a suction chamber, compresses the gas in the cylinder bore, and discharges the gas into a discharge chamber.

The typical piston type compressor draws the refrigerant gas from an external refrigerant circuit into a suction chamber by way of the crank chamber. In such a compressor, in which the crank chamber constitutes a portion of a refrigerant gas passage, the refrigerant gas from the external refrigerant circuit passing through the crank chamber sufficiently lubricates various parts in the crank chamber, such as the piston and the swash plate, with the lubricating oil suspended in the gas.

There is also a type of compressor that draws in refrigerant gas from an external refrigerant circuit without having the gas flow through its crank chamber. In such a compressor, the driving plate, or swash plate, is supported so that it inclines with respect to the drive shaft. The inclination of the swash plate changes in accordance with the difference between the pressure in the crank chamber and the pressure in the cylinder bores. The displacement of the compressor varies in accordance with the inclination of the swash plate. The difference between the pressure in the crank chamber and the pressure in the cylinder bores is changed, for example, by adjusting the pressure in the crank chamber using a control valve. Since the pressure of the crank chamber is adjusted to control the inclination of the swash plate in such type of compressor, the crank chamber is not included in the suction passage. Therefore, the various parts in the crank chamber are lubricated mainly by lubricating oil that is included in blowby gas. Blowby gas refers to the refrigerant gas in the cylinder bore that leaks into the crank chamber through the space defined between the outer surface of the piston and the wall of the associated cylinder bore when the piston compresses the refrigerant gas in the cylinder bore.

The amount of blowby gas, or lubricating oil, supplied to the crank chamber is determined by the dimension of the clearance defined between the outer surface of the piston and the wall of the cylinder bore. Accordingly, it is necessary to increase the dimension of the clearance to supply a sufficient amount of lubricating oil for satisfactory lubrication of the various parts in the crank chamber. However, a large clearance between the piston and the cylinder bore degrades the compressing efficiency of the compressor.

To cope with this problem, compressors such as that shown in FIG. 8 are known in the prior art. The compressor has a swash plate 100. The swash plate 100 is mounted on a drive shaft 104 in a crank chamber 103, which is provided between the cylinder block 101 and the front housing 102, and supported so as to rotate integrally with the shaft 104. Single-headed pistons 105 are each accommodated in a cylinder bore 101*a*, which is provided in the cylinder block 101. A skirt 105*a* projects from the rear side of each piston 105 (to the left as viewed in FIG. 8) toward the crank chamber 103. The skirt 105*a* is operably connected to the swash plate 100 by a pair of shoes 106. Each shoe 106 is slidably clamped between the skirt 105*a* and the swash plate 100. The rotation of the drive shaft 104 is converted to the linear reciprocation of the piston 105 in the cylinder bore 101*a* by means of the swash plate 100 and the shoes 106.

An annular groove 107 extends along the outer surface of each piston 105. Lubricating oil applied to the wall of the cylinder bore lOla is collected in the groove 107 and guided toward the crank chamber 103 during reciprocation of the piston 105. The lubricating oil lubricates the connecting portion between the swash plate 100 and the piston 105. Accordingly, in compressors that employ pistons having such structure, the various parts in the crank chamber may be satisfactorily lubricated without enlarging the dimension of the clearance between the piston and the cylinder bore, or without reducing the compressing efficiency of the compressor.

As shown in FIGS. 8 and 9, the skirt 105*a* of the piston 105 has an arched surface 105*b*, which is defined on the surface facing the inner surface of the front housing 102. The arched surface 105*b* slides against the inner surface of the front housing 102. The radius of curvature of the arched surface 105*b* is the same as that of the inner surface of the front housing 102. When the piston 105 reciprocates, the arched surface 105*b* slides against the inner surface of the front housing 102 and prevents the piston 105 from rotating about its axis.

The arched surface 105*b* extends along the entire width of the skirt 105*a* that faces the inner surface of the front housing 102. However, it is difficult to accurately machine the entire arched surface 105*b* so that it has the same radius of curvature as the inner surface of the front housing 102.

Furthermore, the entire arched surface 105*b*, which extends for a wide range, slides against the inner surface of the front housing 102. Thus, when the piston 105 moves from the top dead center position to the bottom dead center position, the lubricating oil on the end face of the skirt 105*a* and the lubricating oil that collects at the bottom of the crank chamber 103 is dispersed toward the left, as viewed in FIG. 8. The lubricating oil is not guided to the connecting portion between the piston 105 and the swash plate 100. Accordingly, this oil is not used efficiently, and the connecting portions between the pistons 105 and the swash plate 100 are not lubricated to the degree that is desirable.

SUMMARY OF THE INVENTION

Accordingly, it is an objective of the present invention to provide a compressor piston that facilitates machining and effectively lubricates the joints connecting the pistons to the driving body with the lubricating oil from the crank chamber.

To achieve the above objective, the present invention discloses a piston for use in a compressor that compresses gas containing lubricating oil. The compressor includes a housing having a crank chamber and a cylinder bore for accommodating the piston. The housing has an inner surface for defining the crank chamber. A driving body is located in the crank chamber. The driving body is operably connected to the piston by a connecting joint. The driving body reciprocates the piston between a top dead center position and a bottom dead center position by means of the connecting joint. The piston has a head for compressing the gas supplied to the cylinder bore, a skirt projecting from the head toward the crank chamber and connected to the driving body. A restrictor is provided on the skirt to prevent the piston from rotating in the cylinder bore. The restrictor has a plurality of sliding portions slidably contacting the inner surface of the housing. Each sliding portion is spaced from one another by a predetermined distance to form a passage for lubricating oil between the sliding portions.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A compressor employing pistons according to a first embodiment of the present invention will now be described with reference to FIGS. 1 to 5.

Figure 1:
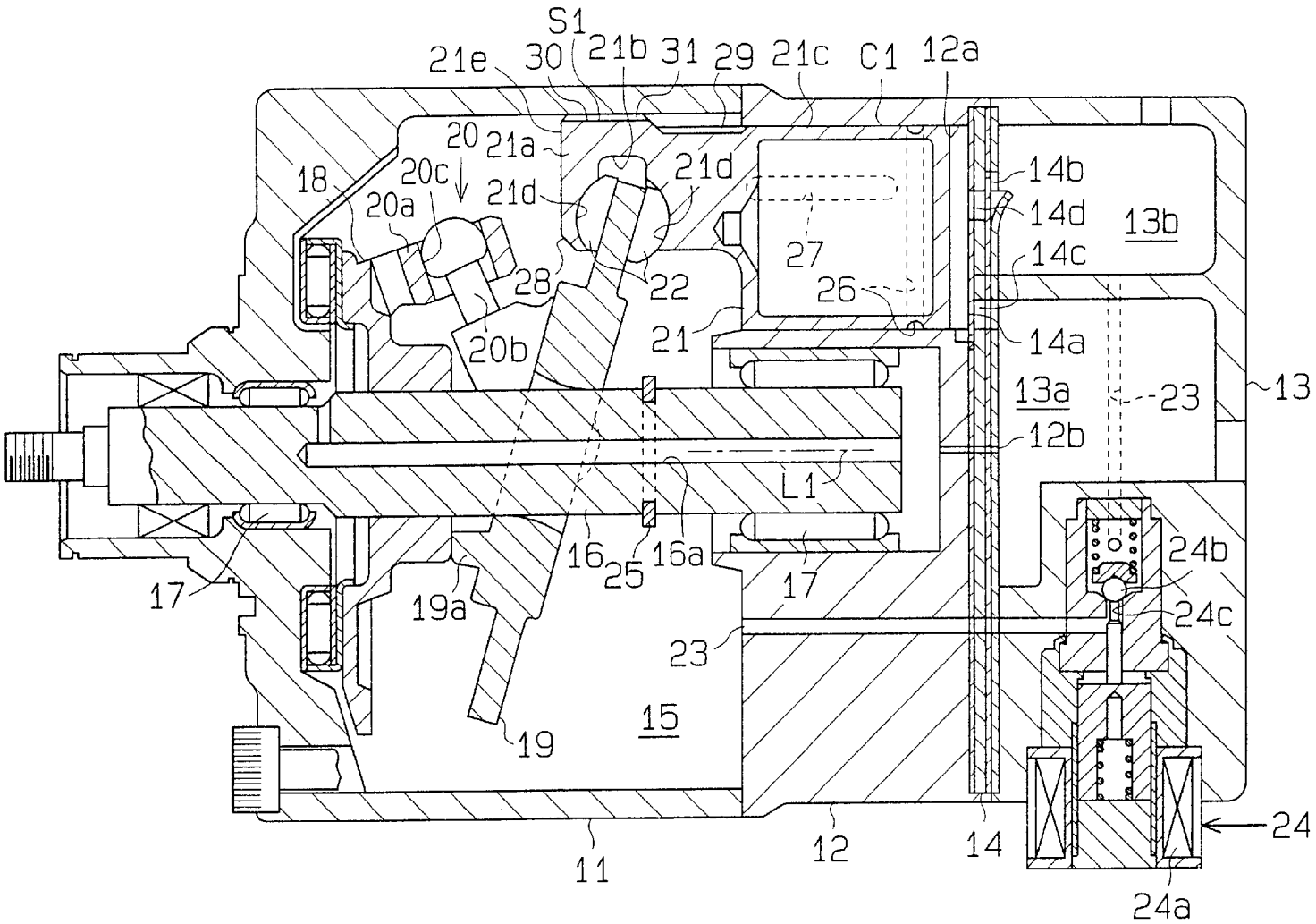
FIG. 1 is a cross-sectional view showing a compressor employing pistons according to a first embodiment of the present invention.

As shown in FIG. 1, a front housing 11 is secured to the front end of a cylinder block 12. A rear housing 13 is secured to the rear end of the cylinder block 12 with a valve plate 14 arranged in between. The front housing 11, the cylinder block 12, and the rear housing 13 constitute the compressor housing.

A suction chamber 13*a* and a discharge chamber 13*b* are defined in the rear housing 13. The valve plate 14 is provided with suction valves 14*a*, discharge valves 14*b*, suction ports 14*c*, and discharge ports 14*d*. A crank chamber 15 is defined between the front housing 11 and the cylinder block 12. A drive shaft 16 extends through the crank chamber 15 and is rotatably supported by a pair of bearings 17 in the front housing 11 and the cylinder block 12.

A lug plate 18 is fixed to the rotary shaft 16. A swash plate 19, which serves as a driving body, is supported in the crank chamber 15 by the drive shaft 16 so that it is slidable and inclinable with respect to the axis L1 of the shaft 16. The swash plate 19 is connected to the lug plate 18 by a hinge mechanism 20. The hinge mechanism 20 is constituted by a support arm 20*a*, which projects from the lug plate 18, and a pair of guide pins 20*b*, which are projected from the swash plate 19. The guide pins 20*b* slidably fit into a pair of guide bores 20*c*, which extend through the support arm 20*a*. The hinge mechanism 20 integrally rotates the swash plate 19 with the drive shaft 16. The hinge mechanism 20 also guides the inclination and movement of the swash plate 19 in the direction of the axis L1.

A plurality of cylinder bores 12*a* extend through the cylinder block 12 about the drive shaft 16. A single-headed piston 21 is reciprocally retained in each cylinder bore 12*a*. The piston 21 includes a hollow head 21*c*, and a skirt 21*a* projecting from the rear end of the head 21*c* toward the crank chamber 15. A slot 21*b* facing the drive shaft 16 is provided in the skirt 21*a*. The slot 21*b* has a pair of opposing walls. A concave seat 21*d* is defined in each wall to receive a shoe 22. Each shoe 22 has a spherical portion and a flat portion. The spheric portion of each shoe 22 is slidably received in each seat 21*d*.

The peripheral portion of the swash plate 19 is slidably held in the slot 21*b* of each piston 21 between the flat portions of the associated pair of shoes 22. Each shoe 22 serves as a connecting member, which connects the piston 21 to the swash plate 19. The rotation of the drive shaft 16 is converted to the linear reciprocation of each piston 21 in the associated cylinder bore 12*a*. During the suction stroke, in which the piston 21 moves from the top dead center position to the bottom dead center position, the refrigerant gas in the suction chamber 13*a* is forced out of the associated suction port 14*c* and suction valve 14*a* and drawn into the cylinder bore 12*a*. During the compression stroke, in which the piston 21 moves from the bottom dead center position to the top dead center position, the refrigerant gas in the cylinder bore 12*a* is compressed and forced out of the bore 12*a* through the associated discharge port 14*d* and discharge valve 14*b*.

A pressurizing passage 23 extends through the cylinder block 12, the valve plate 14, and the rear housing 13 to connect the discharge chamber 13*b* to the crank chamber 15. An electromagnetic valve, or displacement control valve 24, is provided in the rear housing 13 and arranged in the pressurizing passage 23. The control valve 24 includes a solenoid 24*a*, a body 24*b*, and an aperture 24*c*. When the solenoid 24*a* is excited, the body 24*b* closes the aperture 24*c*. When the solenoid is de-excited, the body 24*b* opens the aperture 24*c*.

A pressure releasing passage 16*a* extends through the drive shaft 16. A pressure releasing bore 12*b* extends through the cylinder block 12 and the valve plate 14. The releasing passage 16*a* and the releasing bore 12*b* connects the crank chamber 15 to the suction chamber 13*a*.

When the solenoid 24*a* is excited and the pressuring passage 23 is closed, the high-pressure refrigerant gas in the discharge chamber 13*b* is not sent to the crank chamber 15. In this state, the refrigerant gas in the crank chamber 15 flows into the suction chamber 13*a* through the releasing passage 16*a* and the releasing bore 12*b*. This causes the pressure of the crank chamber 15 to approach the low pressure of the suction chamber 13*a*. As a result, the swash plate 19 is moved to a maximum inclination position, as shown in FIG. 1, and the displacement of the compressor becomes maximum. The swash plate 19 is restricted from inclining beyond the maximum inclination position by the abutment of a stopper 19*a*, which is provided on the front side of the swash plate 19, against the lug plate 18.

When the solenoid 24*a* is de-excited and the pressurizing passage 23 is opened, the high-pressure refrigerant gas in the discharge chamber 13*b* is sent to the crank chamber 15. This increases the pressure of the crank chamber 15. As a result, the swash plate 19 is moved to a minimum inclination position and the displacement of the compressor becomes minimum. The swash plate 19 is restricted from inclining further beyond the minimum inclination position by the abutment of the swash plate 19 against a ring 25, which is fit to the drive shaft 16.

As described above, the pressure of the crank chamber is adjusted by exciting the solenoid 24*a* of the control valve 24 to close the pressurizing passage 23 or by de-exciting the solenoid 24*a* to open the pressurizing passage 23. When the pressure of the crank chamber 15 changes, the difference between the pressure acting on the rear surface of the piston 21 (to the left as viewed in FIG. 1) and the pressure acting on the front surface of the piston 21 (to the right as viewed in FIG. 1) is altered. The inclination of the swash plate 19 is altered in accordance with the pressure difference. This changes the stroke of the pistons 21 and varies the displacement of the compressor.

Figure 2:
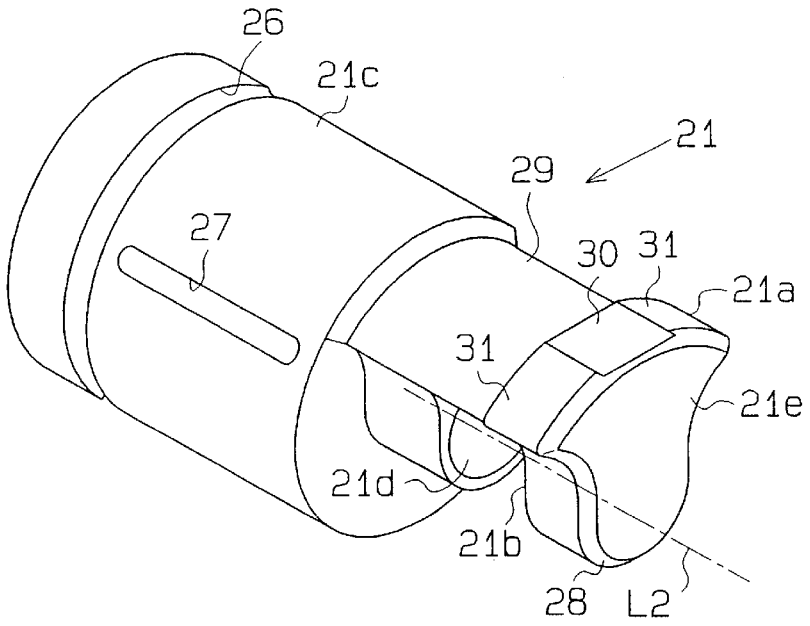
FIG. 2 is an enlarged perspective view showing the piston of FIG. 1.
Figure 3:
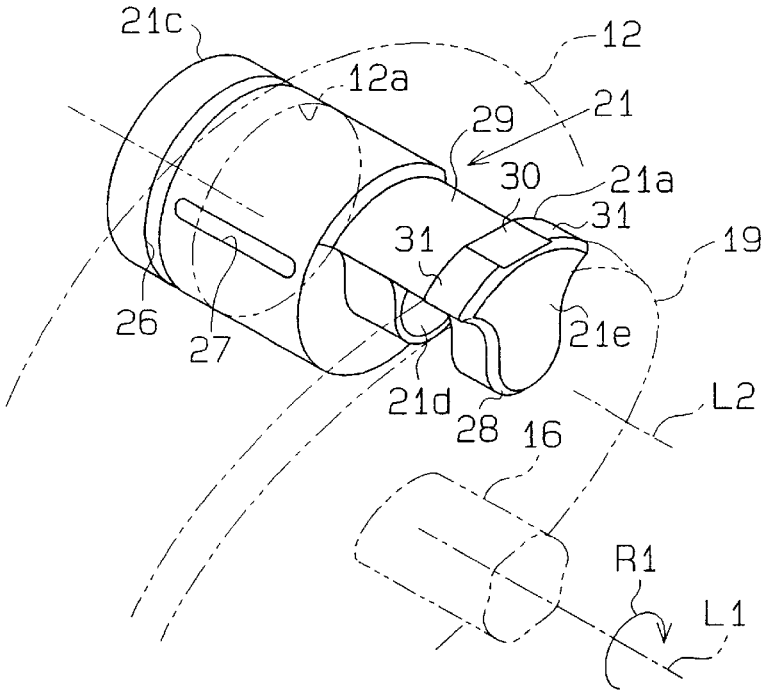
FIG. 3 is a perspective view showing the piston located at the bottom dead center position.

As shown in FIGS. 1 through 4, each piston 21 has an annular groove 26, which extends in the circumferential direction along the cylindrical outer surface of the piston 21 near the top of the head 21*c*. As shown in FIG. 3, the annular groove 26 is provided at a position where the groove 26 is not exposed to the inside of the crank chamber 15 when the piston 21 is located at the bottom dead center position. In FIGS. 1 through 3, the swash plate 9 is shown at the maximum inclination position.

Figure 4:
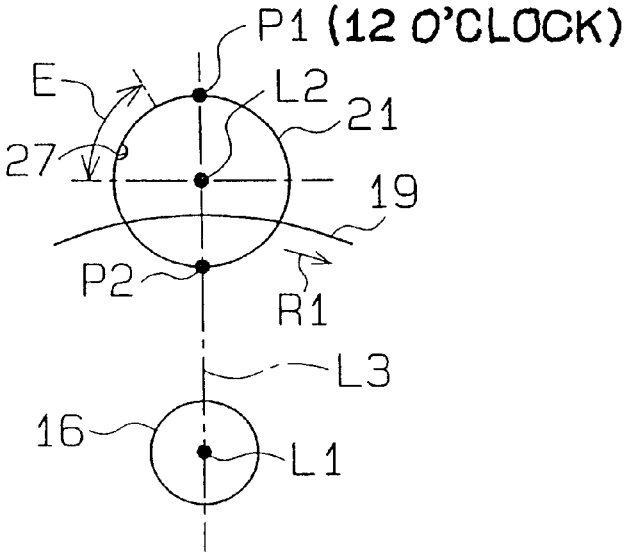
FIG. 4 is a schematic view illustrating the position of the linear groove with respect to the piston.

Each piston 21 also has a linear groove 27, which extends along the outer surface of the piston 21 parallel to the axis L2 of the piston 21. One end of the linear groove 27 is located at the vicinity of the annular groove 26. The linear groove 27 is located on the outer surface of the piston 21 at a position described below. As shown in FIG. 4, when viewing the piston 21 so that the rotating direction R1 of the rotary shaft 6 is clockwise (in this drawing, the piston 21 is viewed from the skirt side), an imaginary straight line L3 extends intersecting the axis L1 of the drive shaft 16 and the axis L2 of the piston 21. Along the two intersecting points P1, P2 at which the straight line L3 and the outer surface of the piston 21 intersect, the position of the intersecting point P1, located at the farther side of the outer surface with respect to the axis L2 of the piston 21, is herein referred to as the twelve o'clock position. In this case, the linear groove 27 is located within a range E, which is defined between positions corresponding to nine o'clock and eleven o'clock on the outer surface of the piston 21.

As shown in FIG. 1, the position and length of the linear groove 27 is determined so that it is not exposed from the cylinder bore 12*a* to the inside of the crank chamber 15 when the piston 21 moves to the top dead center position. The linear groove 27 is not connected with the annular groove 26.

The surface of the piston 21 is ground using a centerless grinding method. In the centerless grinding method, which is not shown, the workpiece, or piston 21, is held on a rest and ground by rotating the piston 21 together with a grinding wheel. The piston 21 is not held by a chuck. Therefore, if a plurality of linear grooves 27 are provided in the outer surface of the piston 21, the rotating axis of the piston 21 placed on the rest becomes unstable. This hinders precision grinding. Accordingly, it is preferable that the number of linear grooves 27 be minimized so as to enable accurate grinding when employing the centerless grinding method. In this embodiment, the piston 21 is provided with only a single linear groove 27, the width and depth of which are minimized but are sufficient to supply lubricating oil to the crank chamber 15.

Figure 5:
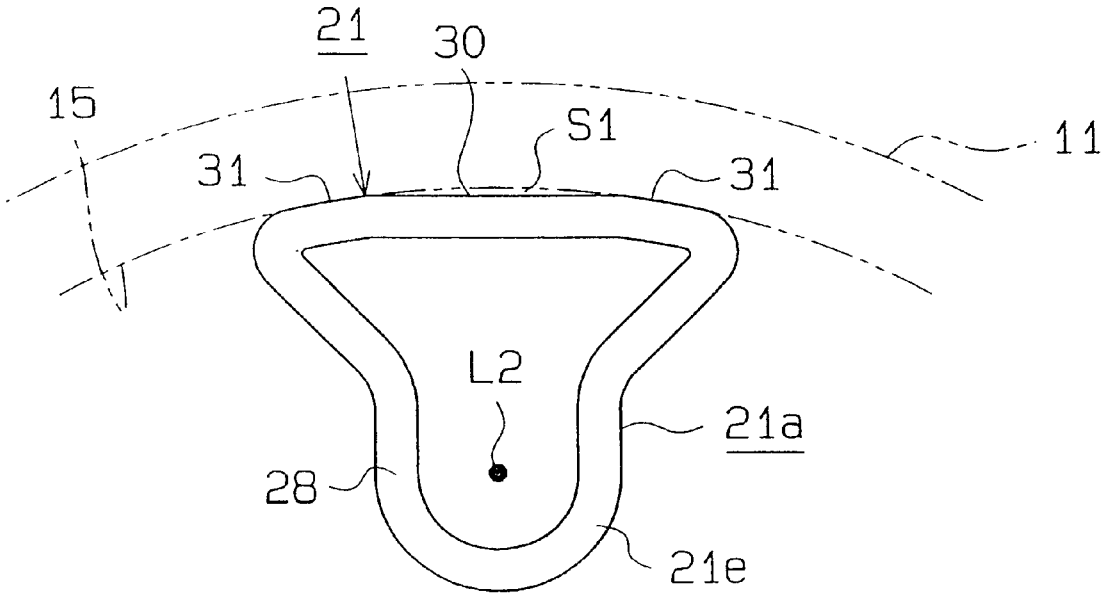
FIG. 5 is an enlarged partial front view showing the skirt of the piston.

As shown in FIGS. 1, 2, and 5, a substantially T-shaped restrictor 2l*e* is provided on each piston 21 at the distal end of the skirt 21*a*. A sloped surface 28 extends along the edge of the end face of the restrictor 21*e*. When the piston 21 moves from the top dead center position to the bottom dead center position, the lubricating oil on the end face of the skirt 21*a* and the inner surface of the front housing 11, and the lubricating oil that collects at the bottom of the crank chamber 15 is guided along the sloped surface 28 toward the portion connecting the piston 21 and the swash plate 19, that is, toward the shoes 22.

A recess 29 facing toward the inner surface of the front housing 11 extends along the skirt 21*a* adjacent to the restrictor 21*e*. The restrictor 21*e* has a flat portion 30, which is located at the middle of the surface facing the inner surface of the front housing 11. The restrictor 21*e* also has a pair of arched surfaces 31 serving to restrict rotation of the piston 21. One arched surface 31 extends from each side of the flat portion 30. The radius of curvature of the arched surfaces 31 is substantially the same as that of the inner surface of the front housing 11. The arched surfaces 31 are in surface contact with the inner surface of the front housing 11. A gap S1 is provided between the flat portion 30 and the inner surface of the front housing 11.

During reciprocation of each piston 21, the arched surfaces 31 of the restrictor 21*e* slide against the inner surface of the front housing 11. This prevents the piston 21 from rotating about its axis L2. Furthermore, during the reciprocation of the piston 21, the lubricating oil in the crank chamber 15 is guided toward the recess 29 through the gap S1 between the flat portion 30 and the inner surface of the front housing 11. The lubricating oil is then sent to the connecting portion between the piston 21 and the swash plate 19, or the shoes 22.

The operation of the compressor having the above structure will now be described.

During the suction stroke, in which the piston 21 moves from the top dead center position to the bottom dead center position, the refrigerant gas in the suction chamber 13 is drawn into the associated cylinder bore 12*a*. Some of the lubricating oil suspended in the refrigerant gas is applied to the wall of the cylinder bore 12*a*. During the discharge stroke, in which the piston 21 moves from the bottom dead center position to the top dead center position, the refrigerant gas in the cylinder bore 12*a* is compressed and discharged into the discharge chamber 13*b*. Furthermore, some of the refrigerant gas (blow-by gas) leaks into the crank chamber 15 through a clearance Cl provided between the outer surface of the piston 21 and the wall of the cylinder bore 12*a*. As the blow-by gas passes through the clearance C1, some of the lubricating oil suspended in the gas is applied to the wall of the cylinder bore 12*a*.

The lubricating oil on the wall of the cylinder bore 12*a* is wiped off by the edge of the annular groove 26 in the piston 21 and collects in the groove 26.

When the piston 21 undergoes the compression stroke, the blow-by gas that leaks out of the cylinder bore 12*a* increases the pressure in the annular groove 26. The linear groove 27 is closed entirely by the wall of the cylinder bore 12*a* only when the piston 21 is located in the vicinity of the top dead center position. If the piston 21 moves away from the top dead center position, at least a portion of the linear groove 27 becomes exposed to the inside of the crank chamber 15.

This causes the pressure in the linear groove 27 to become equal to or slightly higher than the pressure of the crank chamber 15. The linear groove 27 is communicated with the annular groove 26 through the narrow clearance C1. Accordingly, when the piston 21 undergoes the compression stroke, the difference between the pressure in the annular groove 26 and the pressure in the linear groove 27 causes the lubricating oil in the annular groove 26 to move through the clearance C1 and enter the linear groove 27. The lubricating oil that enters the linear groove 27 then enters the crank chamber 15 when the linear groove 27 becomes exposed to the inside of the crank chamber 15.

When the inclination of the swash plate 19 becomes small, the linear groove 27 does not move out of the cylinder bore 12*a* even if the piston 21 is at the bottom dead center position. However, in this embodiment, the distance between the linear groove 27 and the skirt side end of the head 21*c* is short. This easily allows the lubricating oil in the linear groove 27 to move into the clearance C1 and enter the crank chamber 15.

The lubricating oil that enters the crank chamber 15 is applied to the inner surface of the front housing 11 and collects at the bottom of the crank chamber 15. As each piston 21 moves from the top dead center position to the bottom dead center position during the suction stroke, the lubricating oil moves along the sloped surface 28, which is provided along the edge of the end face of the skirt 21*a*, to the connecting portion between the piston 21 and the swash plate 19, or the shoes 22. In addition, the lubricating oil, especially the oil on the inner surface of the front housing, is guided through the gap S1 between the flat portion 30 and the inner surface of the front housing 30 and enters the recess 29. The lubricating oil subsequently lubricates the connecting portion between the piston 21 and the swash plate 19.

Accordingly, when each piston 21 undergoes the suction stroke, the lubricating oil on the end face of the skirt 21*a* and the inner surface of the front housing 11, and the lubricating oil that collects at the bottom of the crank chamber 15 is not dispersed by the movement of the end face of the skirt 21*a*. This causes more effective lubrication of the connecting portion between the piston 21 and the swash plate 19, which is one of the portions that definitely requires lubrication.

As described above, the flat portion 30 is provided on a portion of the surface of the restrictor 21*e* that faces the inner surface of the front housing 11. The pair of arched surfaces 31, which come into surface contact with the inner surface of the front housing 11, extend from each side of the flat portion 30 with a predetermined interval therebetween. Therefore, the entire surface facing the front housing 11 need not be accurately machined to an arch having the same radius of curvature as the inner surface of the front housing 102. This facilitates the machining of the restrictor 21*e*.

The flat portion 30, or recessed portion, provided between the pair of arched surfaces 31 forms a gap S1 between the inner surface of the front housing 11. Thus, when the piston 21 reciprocates, lubricating oil is efficiently applied to the joint between the piston 21 and the swash plate 19 through the gap S1.

The radius of curvature of the arched surfaces 31 is substantially the same as that of the front housing 11. This maximizes the contact area between the restrictor 2l*e* and the inner surface of the front housing 11 regardless of the flat portion 30, which extends along the surface facing toward the inner surface of the front housing 11 but does not contact the inner surface. This further effectively prevents the piston 21 from rotating about its axis L2 and stabilizes the movement of the piston 21.

The sloped surface 28 extends along the edge of the end face of the restrictor 21*e*. Thus, the lubricating oil on the inner surface of the front housing 11 is efficiently directed by the sloped surface 28 to the joint between the piston 21 and the swash plate 19.

Figure 6:
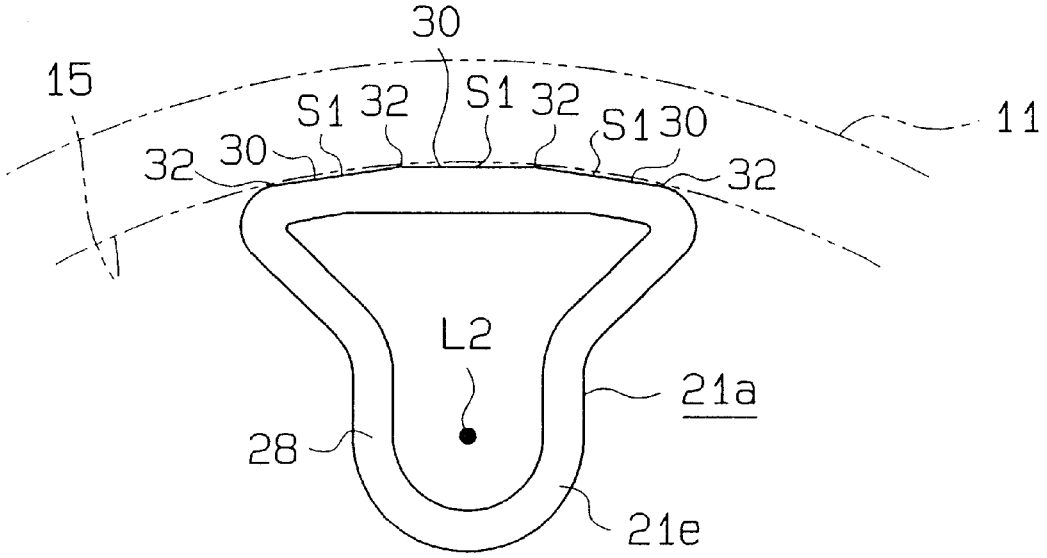
FIG. 6 is a partial front view showing the skirt of a piston according to a second embodiment of the present invention.

A second embodiment according to the present invention will now be described with reference to FIG. 6. In the second embodiment, there are three flat portions 30. One at the middle of the surface facing the inner surface of the front housing 11 and the other two on each side of the first one. A gap S1 is defined between each flat portion 30 and the inner surface of the front housing 11. These gaps S1 allow passage of the lubricating oil.

The intersections between the middle flat portion 30 and the flat portions 30 on each side of the middle flat portion 30 form corners. Each corner, or contact portion 32, extends parallel to the axis L2 of the piston 21 and comes into linear contact with the front housing 11. In this embodiment, the contact portions 32 serve to restrict the rotation of the piston 21. When the piston 21 reciprocates, the contact portions 32 slide against the inner surface of the front housing 11 and prevent the piston 21 from rotating about its axis L2.

Accordingly, the advantageous effects of the first embodiment may be obtained in the second embodiment. In the second embodiment, the restrictor 21*e* has a plurality of flat surfaces 30, which define a plurality of contact portions 32. The contact portions 32 come into linear contact with the inner surface of the front housing 11. Accordingly, the surface facing the inner surface of the front housing 11 need only be machined flat. It is not necessary to machine the surface in an arched manner. This further facilitates the machining of the restrictor 21*e*. In addition, the lubricating oil from the crank chamber 15 passes through the plurality of gaps S1 and lubricates the connecting portion between the piston 21 and the swash plate 19 more efficiently.

Figure 7:
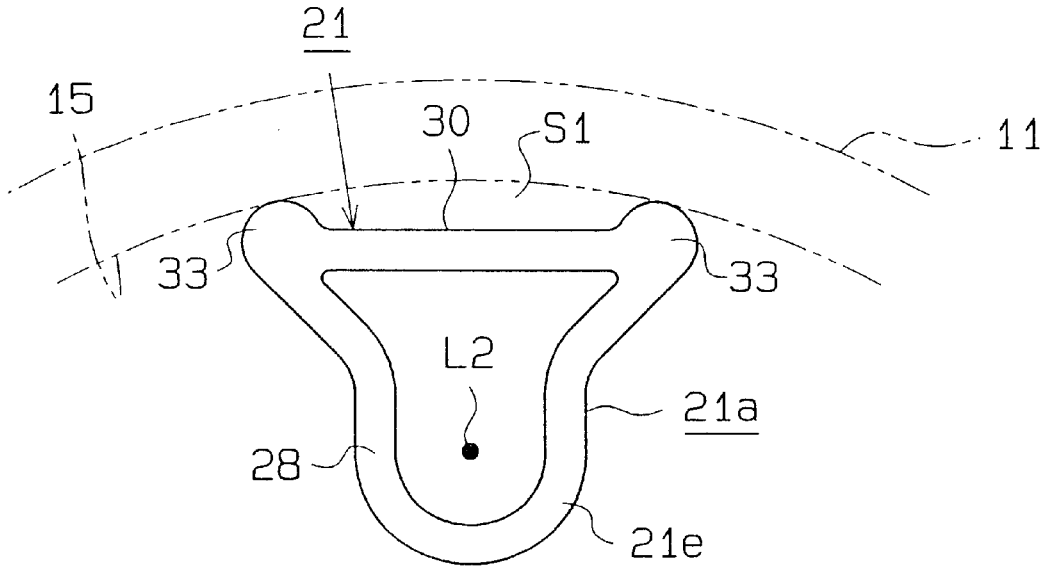
FIG. 7 is a partial front view showing the skirt of a piston according to a third embodiment of the present invention.
Figure 8:
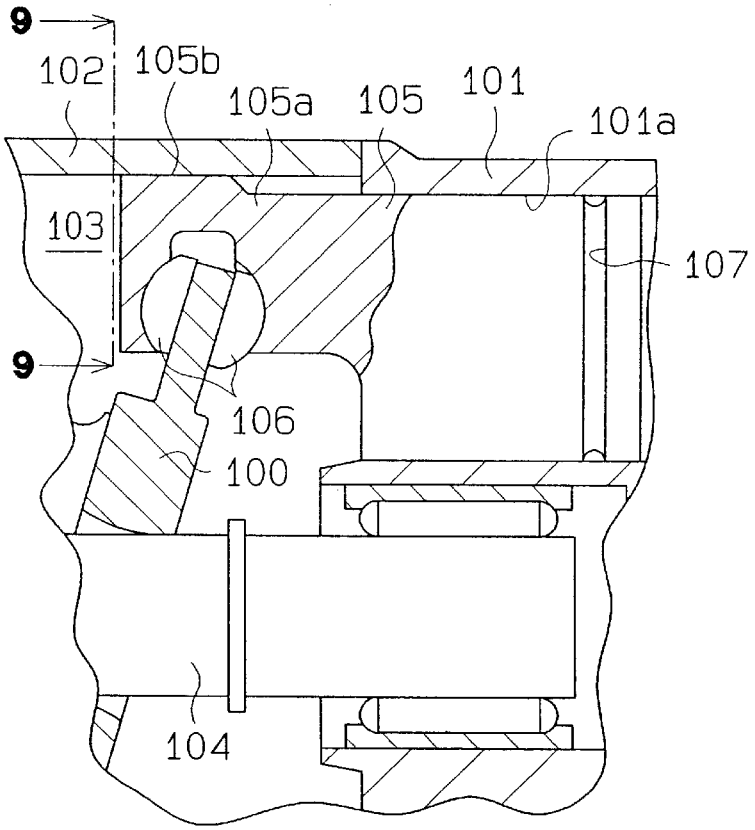
Fig.8(Prior Art)
FIG. 8 is a partial cross-sectional view showing a prior art compressor.
Figure 9:
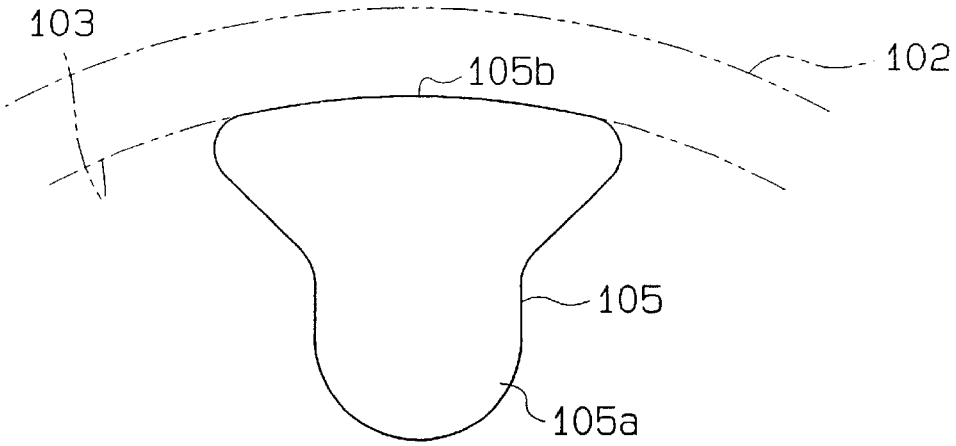
Fig.9(Prior Art)
FIG. 9 shows a cross-sectional view taken along line 9—9 in FIG. 8.

A third embodiment according to the present invention will now be described with reference to FIG. 7. Like the first embodiment, in the third embodiment, the flat portion is provided at the middle of the surface of the restrictor 21*e* facing the inner surface of the front housing 11. A pair of lips 33, which serve to restrict the rotation of the piston 21, is provided on the sides of the flat portion 30. The lips 33 extend parallel to the axis of the piston 21 and contact the inner surface of the front housing 11. When the piston 21 reciprocates, the lips 33 slide against the inner surface of the front housing 11 and prevents the piston 21 from rotating about its axis L2.

The advantageous effects of the first and second embodiment is also obtained in the third embodiment. Furthermore, in this embodiment, the lips 33 form a large gap S1 between the flat portion 30 and the inner surface of the front housing 11 to allow passage of the lubricating oil. Thus, when the piston 21 reciprocates, the lubricating oil from the crank chamber 15 passes through the large gap S1 and lubricates the joint between the piston 21 and the swash plate 19 further efficiently.

Although several embodiments of the present invention have been described so far, it should be apparent to those skilled in the art that the present invention may be embodied in many other specific forms without departing from the spirit or scope of the invention. More particularly, the present invention may be modified as described below.

In the restrictor 21*e*, the structure of the portion that serves to restrict rotation of the piston 21 is not limited as long as there are two or more of such portions with a predetermined interval therebetween.

In the first, second, and third embodiments, the flat portion 30 defines the gap S1 between the restrictor 21*e* and the inner surface of the front housing 11. However, instead of using the flat portion 30, a groove or recess provided in the restrictor 21*e* may be used to define the gap S1.

Therefore, the present examples and embodiments are to be considered as illustrative and not restrictive and the invention is not to be limited to the details given herein, but may be modified within the scope of the appended claims.

What is claimed is:

1. A piston for use in a compressor that compresses gas containing lubricating oil, wherein the compressor includes a housing having a crank chamber and a cylinder bore for accommodating the piston, the housing having an inner surface for defining the crank chamber, the compressor further including a driving body located in the crank chamber, the driving body being operably connected to the piston by a connecting joint, the driving body for reciprocating the piston between a top dead center position and a bottom dead center position by means of the connecting joint, the piston comprising:

a head for compressing the gas supplied to the cylinder bore;

a skirt projecting from the head toward the crank chamber and connected to the driving body; and a restrictor provided on the skirt to prevent rotation of the piston in the cylinder bore, the restrictor having a plurality of sliding portions for slidably contacting the inner surface of the housing, the restrictor being dimensioned such that the sliding portions are in substantially concurrent slidable contact with the inner surface of the housing upon assembly of the compressor and during reciprocation of the piston, each sliding portion being spaced from one another by a predetermined distance to form a passage for lubricating oil between the sliding portions.

2. The piston according to claim 1, wherein the restrictor has a recessed portion located between the sliding portions and free from contact with the inner surface of the housing, the recessed portion for defining a gap for allowing passage of the oil between the recessed portion and the inner surface of the housing, the gap leading the oil in the crank chamber toward the connecting joint when the piston moves from the top dead center position to the bottom dead center position.

3. The piston according to claim 2, wherein each sliding portion includes an arched surface having a radius of curvature that is substantially the same as that of the inner surface of the housing to enable surface contact with the inner surface.

4. The piston according to claim 2, wherein each sliding portion extends in the direction of the axis of the piston for making line contact with the inner surface of the housing.

5. The piston according to claim 2, wherein each sliding portion includes a raised portion extending along an axis of the piston.

6. The piston according to claim 2, wherein the recessed portion includes a substantially flat surface.

7. The piston according to claim 1, wherein the skirt has a recess located between the restrictor and the head to define a space for allowing passage of the oil between the skirt and the inner surface of the housing.

8. The piston according to claim 1, wherein the driving body includes a swash plate and the compressor includes:

a drive shaft for tiltably supporting the driving body, wherein the inclination of the driving body varies in accordance with the difference between the pressure in the crank chamber and the pressure in the cylinder bore, and wherein the piston moves by a stroke based on the inclination of the driving body to control the displacement of the compressor; and means for adjusting the difference between the pressure in the crank chamber and the pressure in the cylinder bore.

9. The piston according to claim 1, wherein the driving body includes a swash plate and the compressor includes:

a drive shaft for supporting the driving body; and a pair of shoes included in the connecting joint and received in the skirt of the piston to slidably hold the driving body.

10. A piston for use in a compressor that compresses gas containing lubricating oil, wherein the compressor includes a housing having a crank chamber and a cylinder bore for accommodating the piston, the housing having an inner surface for defining the crank chamber, the compressor further including a driving body located in the crank chamber and supported on a drive shaft, the driving body being operably connected to the piston by a connecting joint to convert the rotation of the drive shaft to reciprocation of the piston between a top dead center position and a bottom dead center position, the piston comprising:

a head for compressing the gas supplied to the cylinder bore;

a skirt projecting from the head toward the crank chamber, the head being connected to the driving body;

a restrictor provided on the skirt to prevent rotation of the piston in the cylinder bore, the restrictor having a plurality of sliding portions slidably contacting the inner surface of the housing and a recessed portion located between the sliding portions, wherein the recessed portion is free from contact with the inner surface of the housing, the restrictor being dimensioned such that the sliding portions are in substantially concurrent slidable contact with the inner surface of the housing upon assembly of the compressor and during reciprocation of the piston; and wherein the recessed portion defines a gap between the recessed portion and the inner surface of the housing for allowing the flow of oil, the gap leading the oil in the crank chamber toward the connecting joint when the piston moves from the top dead center position to the bottom dead center position.

11. The piston according to claim 10, wherein the sliding portions include a pair of arched surfaces, each arched surface having a radius of curvature that is substantially the same as that of the inner surface of the housing to enable surface contact with the inner surface, and wherein the recessed portion includes a flat surface.

12. The piston according to claim 10, wherein each sliding portion extends in the direction of the axis of the piston for making line contact with the inner surface of the housing.

13. The piston according to claim 10, wherein the sliding portions include a pair of raised portions extending along an axis of the piston.

14. The piston according to claim 10, wherein the skirt has a recess located between the restrictor and the head to define a space for allowing passage of the oil between the skirt and the inner surface of the housing.

15. The piston according to claim 14, wherein the compressor includes:

a swash plate forming the driving body and being tiltably supported on the drive shaft, wherein the inclination of the swash plate varies in accordance with the difference between the pressure in the crank chamber and the pressure in the cylinder bore, and wherein the piston moves by a stroke based on the inclination of the swash plate to control the displacement of the compressor; and means for adjusting the difference between the pressure in the crank chamber and the pressure in the cylinder bore.

16. The piston according to claim 14, wherein the compressor includes:

a swash plate forming the driving body; and a pair of shoes included in the connecting joint and received in the skirt of the piston to slidably hold the swash plate.

17. A compressor for compressing gas containing lubricating oil, comprising a housing defining a cylinder bore and having an inner surface defining a crank chamber, a driving body located in the crank chamber and supported on a drive shaft, and a piston comprising a head and a skirt, said piston being accommodated in the cylinder bore and operably connected to the driving body by a connecting joint, wherein the driving body converts the rotation of the drive shaft to reciprocation of the piston between a top dead center position and a bottom dead center position;

a restrictor provided on the skirt to prevent rotation of the piston in the cylinder bore, the restrictor having a plurality of sliding portions concurrently slidably contacting the inner surface of the housing and a recessed portion located between the sliding portions, the recessed portion being free from contact with the inner surface of the housing, the restrictor being dimensioned such that the sliding portions are in substantially concurrent slidable contact with the inner surface of the housing upon assembly of the compressor and during reciprocation of the piston; and the recessed portion defining a gap between the recessed portion and the inner surface of the housing for allowing the passage of oil, wherein the gap leads the oil in the crank chamber toward the connecting joint when the piston moves from the top dead center position to the bottom dead center position.

18. A piston for use in a compressor that compresses gas containing lubricating oil, wherein the compressor includes a housing having a crank chamber and a cylinder bore for accommodating the piston, the housing having an inner surface for defining the crank chamber, the compressor further including a driving body located in the crank chamber, the driving body being operably connected to the piston by a connecting joint, the driving body for reciprocating the piston between a top dead center position and a bottom dead center position by means of the connecting joint, the piston comprising:

a head having a cylindrically shaped outer peripheral surface, a top end for compressing the gas supplied to the cylinder bore, and a rear end, the head having a linear groove in said outer peripheral surface extending in the axial direction between respective opposite ends thereof entirely within said cylindrical shape of the piston head and introduces lubricating oil within the cylinder bore to the crank chamber when the piston is driven from the bottom dead center position to the top dead center position;

a skirt projecting from said rear end of the head toward the crank chamber, the skirt being connected to the driving body;

a restrictor provided on the skirt to prevent the piston from rotating in the cylinder bore;

a plurality of sliding portions on the restrictor, wherein the sliding portions contact the inner surface of the housing, the sliding portions being spaced from one another by a predetermined distance to form a passage for lubricating oil between the sliding portions; and a recessed portion located between the sliding portions and free from contact with the inner surface of the housing, wherein the recessed portion defines a gap for allowing passage of the oil between the recessed portion and the inner surface of the housing, wherein the gap leads the oil in the crank chamber toward the connecting joint when the piston moves from the top dead center position to the bottom dead center position.

19. The piston according to claim 18, wherein the head has an annular groove, and wherein, when the piston is reciprocated, lubricating oil within the cylinder bore is stored in the annular groove.

20. The piston according to claim 18, wherein each sliding portion includes an arched surface having a radius of curvature that is substantially the same as that of the inner surface of the housing to enable surface contact with the inner surface of the housing.

21. The piston according to claim 18, wherein each sliding portion extends in the direction of the axis of the piston and makes line contact with the inner surface of the housing.

22. The piston according to claim 18, wherein each sliding portion includes a raised portion extending along an axis of the piston.

23. The piston according to claim 18, wherein the recessed portion includes a flat surface.

* * * * *

UNITED STATES PATENT AND TRADEMARK OFFICE
CERTIFICATE OF CORRECTION

PATENT NO. : 5,988,041

DATED : November 23, 1999

INVENTOR(S) : Osamu HIRAMATSU et al

It is certified that error appears in the above-identified patent and that said Letters Patent is hereby corrected as shown below:

Title page, at "[73] Assignee:" change "Jodoshokki Seiksakusho" to --Jidoshokki Seisakusho--.

Column 8, line 41, after "portion" insert --30--.

Signed and Sealed this

Third Day of April, 2001

Nicholas P. Godici

*Attest:*

NICHOLAS P. GODICI

*Attesting Officer*

*Acting Director of the United States Patent and Trademark Office*